US006502330B1

(12) United States Patent
David et al.

(10) Patent No.: US 6,502,330 B1
(45) Date of Patent: Jan. 7, 2003

(54) SOLE FOR FOOTWEAR

(76) Inventors: Loic David, Chemin des Prairies, F-38690 Le Grand Lemps (FR); Jean-Jaques Rivet, 88 Impasse Meayne, "Mas Bouscatie", F-06550 La Roquette/Siagne (FR); Michel Maestro, 13 avenue Maurice Donat, F-06721 Saint Laurent du Var (FR)

( * ) Notice: Subject to any disclaimer, the term of this patent is extended or adjusted under 35 U.S.C. 154(b) by 0 days.

(21) Appl. No.: 09/720,485

(22) PCT Filed: May 25, 2000

(86) PCT No.: PCT/FR00/01421

§ 371 (c)(1),
(2), (4) Date: Mar. 2, 2001

(87) PCT Pub. No.: WO00/72713

PCT Pub. Date: Dec. 7, 2000

(30) Foreign Application Priority Data

May 26, 1999 (FR) ..... 99 06899

(51) Int. Cl.[7] ..... A43B 7/14; A43B 7/16; A43B 13/38; A43B 19/00; A61F 5/14

(52) U.S. Cl. ..... 36/88; 36/92; 36/71; 36/43; 36/144; 36/173; 36/174

(58) Field of Search ..... 36/88, 92, 91, 36/25 R, 28, 29, 30 R, 31, 37, 35 B, 71, 43, 44, 142, 143, 144, 166, 173, 174, 176, 179, 180, 181

(56) References Cited

U.S. PATENT DOCUMENTS

| | | | | | |
|---|---|---|---|---|---|
| 1,741,419 | A | * | 12/1929 | Jones | 36/43 |
| 2,435,776 | A | * | 2/1948 | Geilear | 36/43 |
| 2,546,408 | A | * | 3/1951 | Riggs | 36/43 |
| 3,081,774 | A | * | 3/1963 | Lelyveld | 36/174 |
| 4,494,320 | A | * | 1/1985 | Davis | 36/25 R |
| 4,766,679 | A | * | 8/1988 | Bender | 36/30 R |
| 4,955,148 | A | * | 9/1990 | Padilla | 36/174 |
| 5,542,196 | A | * | 8/1996 | Kantro | 36/174 |
| 5,937,544 | A | * | 8/1999 | Russell | 36/28 |
| 6,247,250 | B1 | * | 6/2001 | Hauser | 36/173 |
| 6,330,757 | B1 | * | 12/2001 | Russell | 36/28 |

FOREIGN PATENT DOCUMENTS

| | | | | |
|---|---|---|---|---|
| GB | 2230935 A | * | 11/1990 | A43B/13/41 |
| WO | WO 95/00047 A1 | * | 1/1995 | A43B/17/03 |

* cited by examiner

*Primary Examiner*—Anthony D. Stashick
(74) *Attorney, Agent, or Firm*—Oliff & Berridge, PLC

(57) ABSTRACT

A sole includes a strengthener in the form of a closed loop which surrounds the zone on which the heel rests and is extended forward in the form of two branches extending along the two edges of the sole at least as far as the zone of the first and fifth metatarsal heads.

14 Claims, 4 Drawing Sheets

12
13
3
10
5
9
6
10
2
7
4

12
III
13
5
3
4
2
10
7
III

SOLE FOR FOOTWEAR

The subject of the present invention is a sole for footwear which is curved into the overall shape of a foot or intended to be adapted to the particular shape of a foot.

It is known practice to use insoles for footwear comprising a surface essentially corresponding to that of the bottom of the item of footwear and possibly fitted with localized support and/or shock-absorbing elements. Such soles may be comfort soles or alternatively may be soles intended to improve the stability of the foot or to protect the bone structure against repetitive shock, particularly for use in sport, such as walking or running.

The sole according to the invention, which may be an insole or an outer sole for footwear, is aimed more specifically at stabilizing the lateral movement of the foot and at assisting and guiding it in its longitudinal movement during walking, running or when participating in other sports.

When walking or participating in some sport, a foot unfurls its various pressure points almost systematically from the outside of the heel forward, passing via the lateral arch and the front of the foot to finish at the big toe. The path of the barycentres in the dynamics of walking describes a curve in the overall shape of an S from the rear forwards and between the outside of the heel and the first inter-metatarsal space.

The speed of walking, just like the speed of running, depends above all on the duration of the pressure phase.

The pressure time depends on the load-absorbing and energy restitution capacity of the anatomical structures. This restitution of energy is associated with the elasticity of the tissue. Now, most chronic lesions are due, above all, to the significant forces involved in the load-bearing phase. Furthermore, the kinetic energy generates sheer forces at the surface of the skin, and these are likely to give rise to lesions. Most chronic lesions do not occur during the landing and shock-absorbing phase but during the load-bearing phase, at the moment when the foot absorbs the load and flattens by pronation, and when it has to restore the energy through elasticity of the tissue and muscular contraction.

The object of the invention is to provide a sole which stabilizes the lateral movement of the foot and guides the latter in its longitudinal movement so as to increase the elastic reserve of the foot.

To this end, the sole to which it relates, of the aforementioned type, comprises a strengthener in the form of a closed loop which surrounds the zone on which the heel rests and is extended forward in the form of two branches extending along the two edges of the sole at least as far as the zone of the first and fifth metatarsal heads. This strengthener may form an integral part of the sole or may be attached under the sole and secured to the latter.

The loop-shaped part of the strengthener surrounding the heel is intended to stabilize its lateral movement upon contact with the ground. Specifically, eversion or inversion thereof during this phase leads to the unfurling of the step shifting off-line during the pressure and propulsion phases, leading to a loss of energy but also, and above all, to risks of trauma in the foot-knee-back department. The longitudinal branches of the strengthener make it possible to orientate the unfurling of the foot and avoid these eversions or inversions of the front of the foot, and furthermore give rise to a "spoon" effect which encourages propulsion.

To encourage this "spoon" effect during propulsion, the branch located on the inside of the sole extends forward beyond the first metatarsal head.

According to another feature of the invention, the central zone of the strengthener located forward of the zone on which the heel rests is raised relative to the zones arranged in front of and behind it.

This structure restrains the heel in its forward tilting movement and actually affords a spring effect during the phase of the step serving as a complement of shock-absorbing to the arches and as additional energy restitution to the "spoon" effect during the propulsion phase.

Advantageously, in its central zone located forward of the zone on which the heel rests, the strengthener has two lateral recesses, the far ends of which are set back from the respective lateral edges of the sole.

By virtue of these recesses, the flexible zones of the foot, or arches, are uncovered, which is in keeping with their dynamic functions of flexibility to provide shock-absorbing and restore energy needed for the unfurling of the step.

According to another feature of this sole, the main part of the sole comprises, in the zone on which the heel rests and/or in the zone that lies between the two branches of the strengthener, an upwards facing bulge corresponding to a downwards facing concave hollow. This is a double concavity in the transverse direction and in the longitudinal direction. When the body weight is applied to one or other of these two bulged zones, vertical force tends to tighten the loop in the case of the rear bulge, or pull the longitudinal branches together in the case of the front bulge, thus improving the stabilizing effect.

Advantageously, in order to enjoy a good rigidity/responsiveness ratio, the strengthener is made of a synthetic material or of a composite material chosen from polymers, polycarbonates, polycarbolactols or carbon- or glass-fibre-reinforced resin.

According to a first embodiment, the strengthener is made as a single piece obtained by cutting out.

According to another embodiment, the strengthener is made from an elongate single piece bent to form a loop and the ends of which form longitudinal branches after crossing in the zone located forward of the heel. The crossing of the two branches forward of the zone that takes the heel forms the desired extra thickness for the heel, and whose function was defined earlier.

Furthermore, in the crossing zone the two branches are secured together or attached in an elastic and adjustable fashion.

According to another embodiment, the strengthener is made in two parts of which one forms the loop surrounding the heel and the branch located on the inside of the sole and of which the other, fixed to the first part on the inside of the sole and in the zone forward of the loop formed by the strengthener, extends essentially transversely with respect to the axis of the sole to meet the outside edge of the sole and form the second longitudinal branch.

Advantageously in this case, the two constituent parts of the strengthener are made of different materials.

The second part, constituting the longitudinal branch extending along the outside of the sole, has an inclined part which forms an angle of between 60 and 90° with the axis known as the metatarsal break, which is the line along which the front of the foot bends. This orientation of the oblique part of the branch allows physiological tilting of the foot from the lateral to the medial, which makes it possible to accelerate the way in which the pressure points unfurl and the phase of slowing the front of the foot, and optimum unfurling of the pressure points to arrive at a pressure point on the big toe, by which the impetus is given.

According to one possibility, the ends of the branches of the strengthener are connected by a bridge, which makes it possible to transfer the body weight more easily from one branch to the other if the weight is bearing too heavily on one of the branches. In order to achieve or improve this realignment effect, at least one of the branches of the strengthener is equipped with a localized elastic pad or spring.

In any case, the invention will be clearly understood with the aid of the description which follows, with reference to the appended diagrammatic drawing which, by way of non limiting examples, depicts a number of embodiments of this sole, in the case of an insole for footwear:

Figure 5:
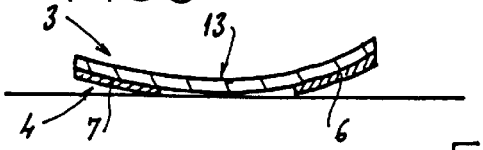
FIGS. 5, 6 and 7 are three views thereof in cross section on V—V, VI—VI and VII—VII of FIG. 3, as the foot is in the course of pressing on the ground.
Figure 5A:
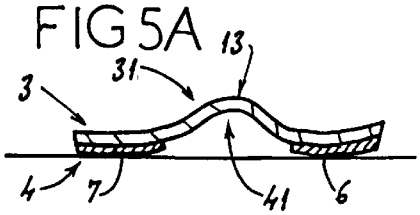
Figure 7:
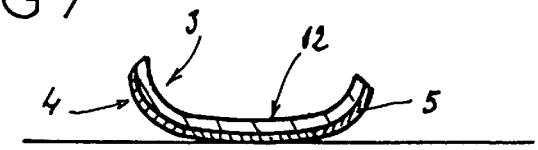
Figure 7A:
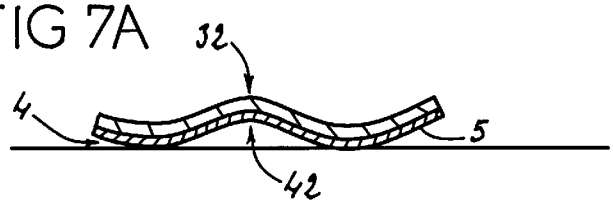
Figure 8:
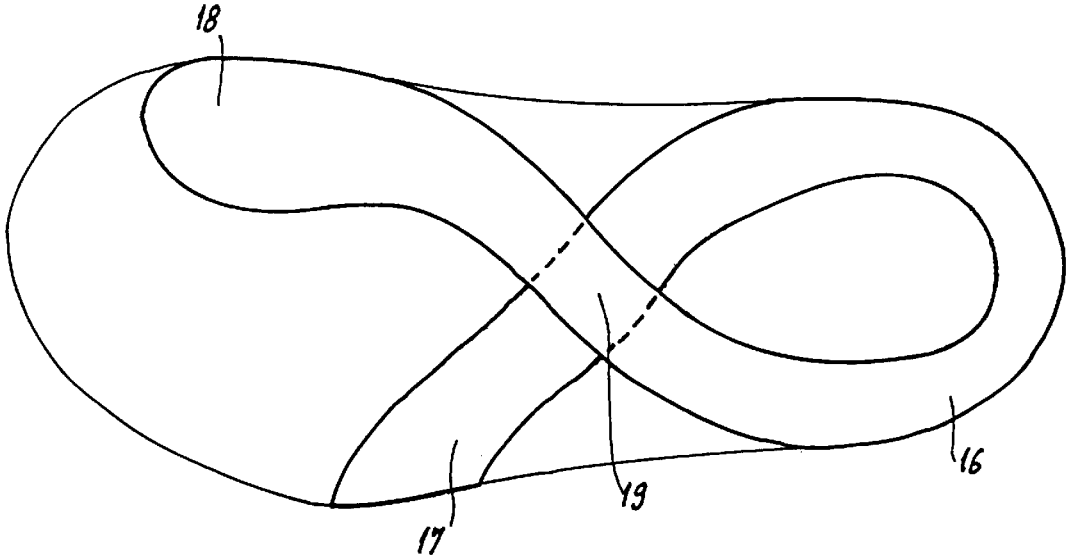
Figure 9:
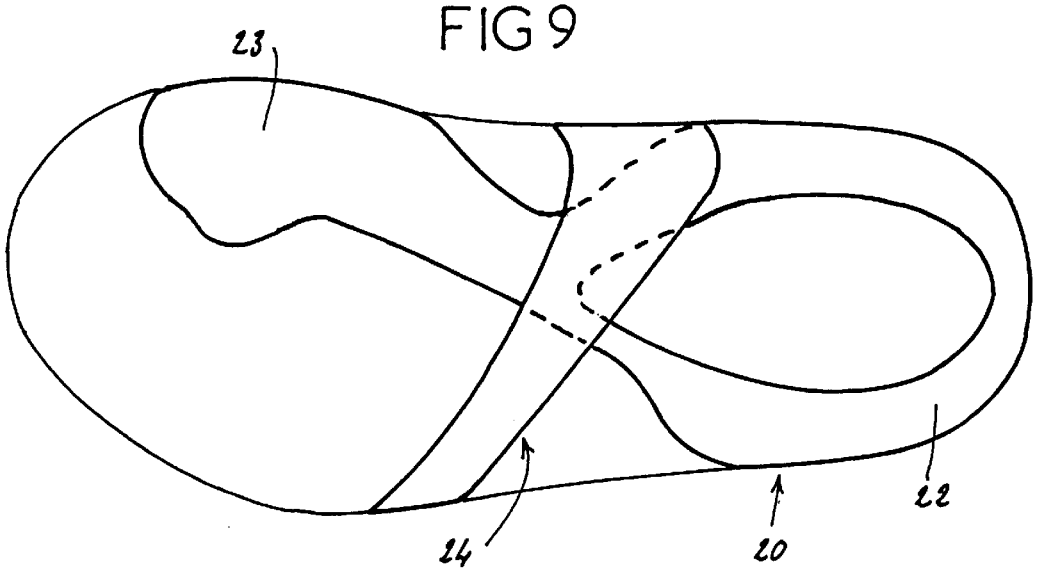
Figure 10:
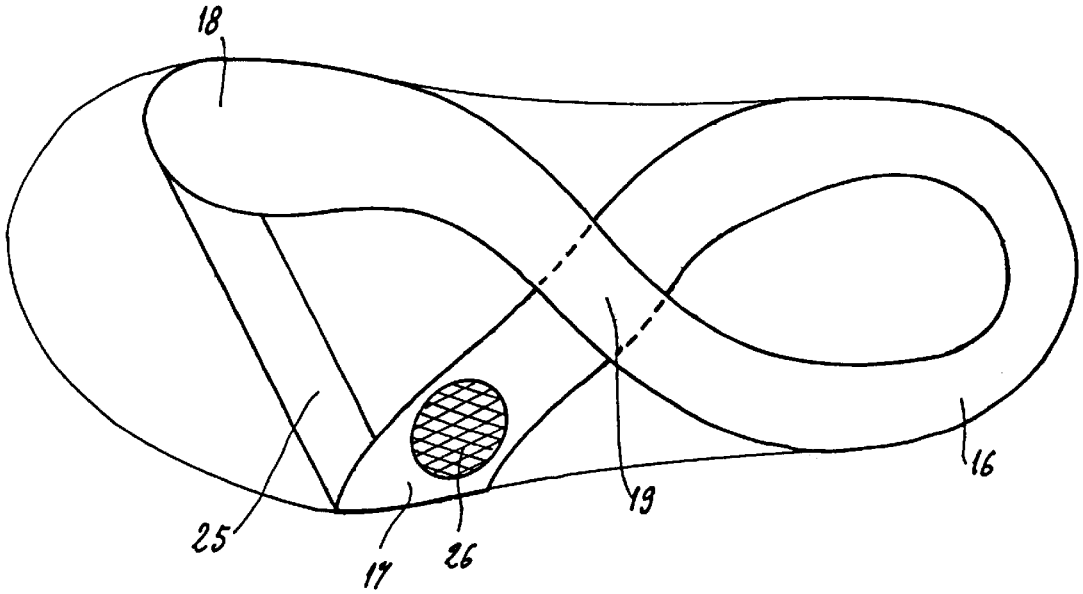

FIGS. 5A and 7A correspond to FIGS. 5 and 7 where the foot is not in the course of pressing the illustrated sections to the ground;

FIG. 8 is a view of a second sole from beneath;

FIG. 9 is a view of a third sole from beneath;

FIG. 10 is a view of a fourth sole from beneath.

Figure 1:
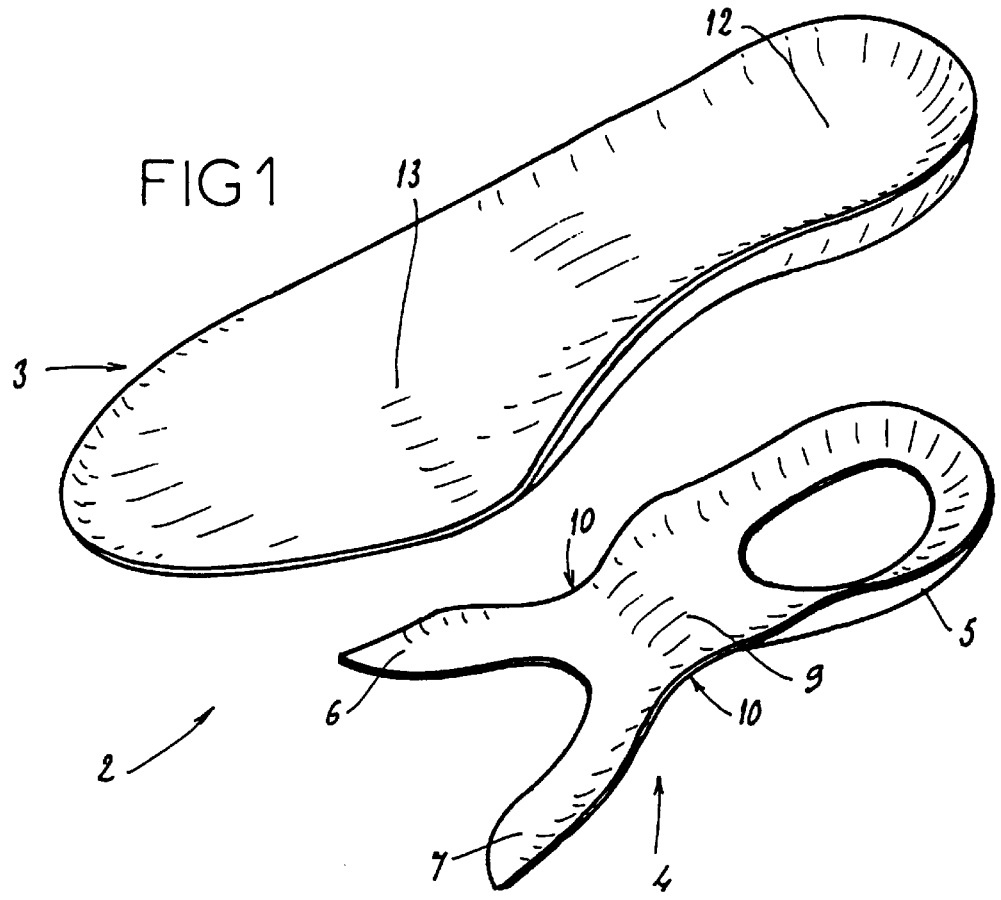
FIG. 1 is an exploded perspective view of this sole.
Figure 2:
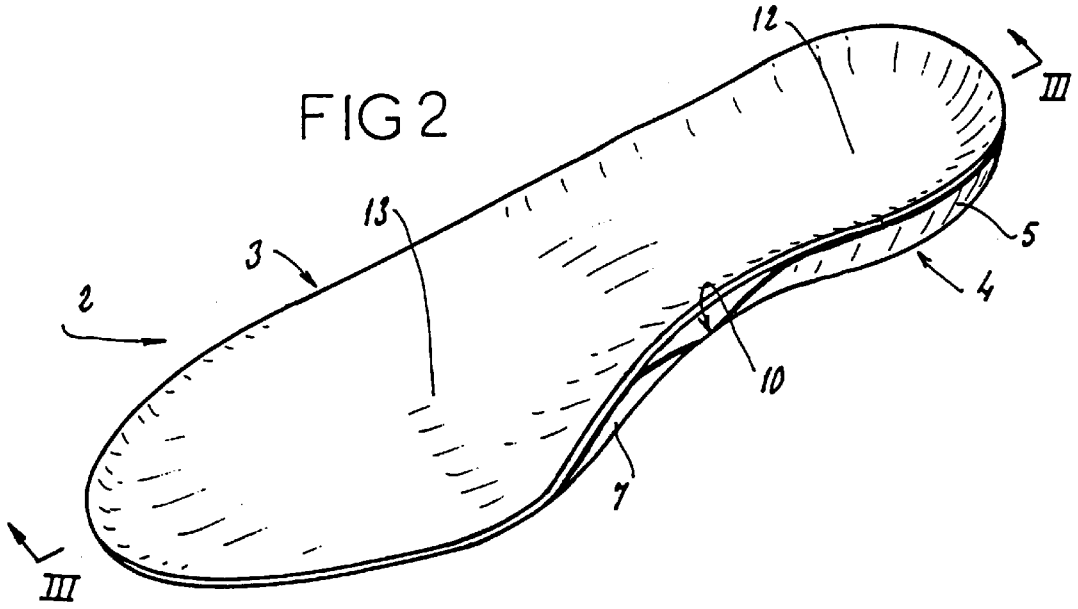
FIG. 2 is a perspective view of the various parts of which it is formed, in the assembled position.
Figure 3:
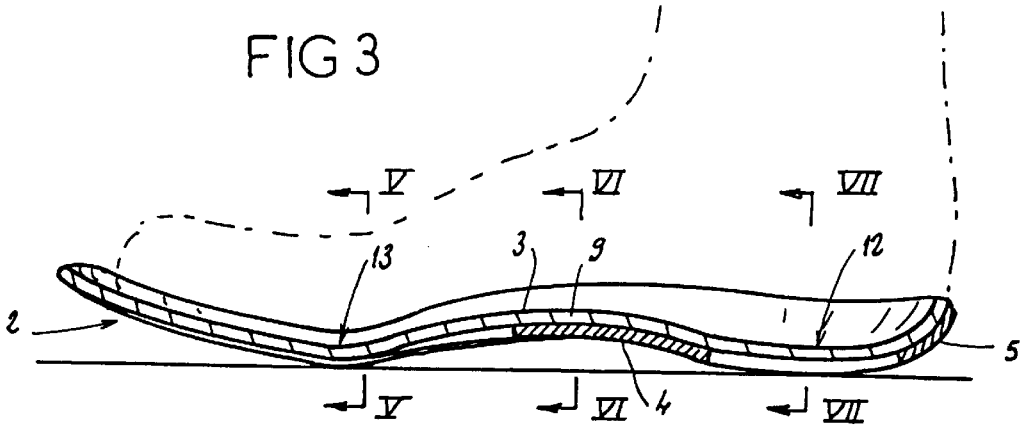
FIG. 3 is a view thereof in longitudinal section on III—III of FIG. 2.

FIG. 1 depicts an insole 2 for footwear, curved to the overall shape of a foot or intended to be adapted to the particular shape of a foot. This sole comprises a main part 3 with a surface corresponding essentially to that of the bottom of the item of footwear, possibly equipped with localized support and/or shock-absorbing elements which have not been depicted in the drawing. This sole also comprises a strengthener 4 which, in the embodiment depicted in FIGS. 1 to 7, is made as a single piece, cut and shaped. This strengthener is made of a synthetic material with a good stiffness-responsiveness ratio, or of a composite material, for example a carbon- or glass-fibre-reinforced resin. This strengthener 4 comprises a loop-shaped part 5 which surrounds the zone on which the heel presses, and which is extended forward by two longitudinal branches 6 and 7 arranged along the two edges of the sole at least as far as the zone of the first and fifth metatarsal heads.

Figure 4:
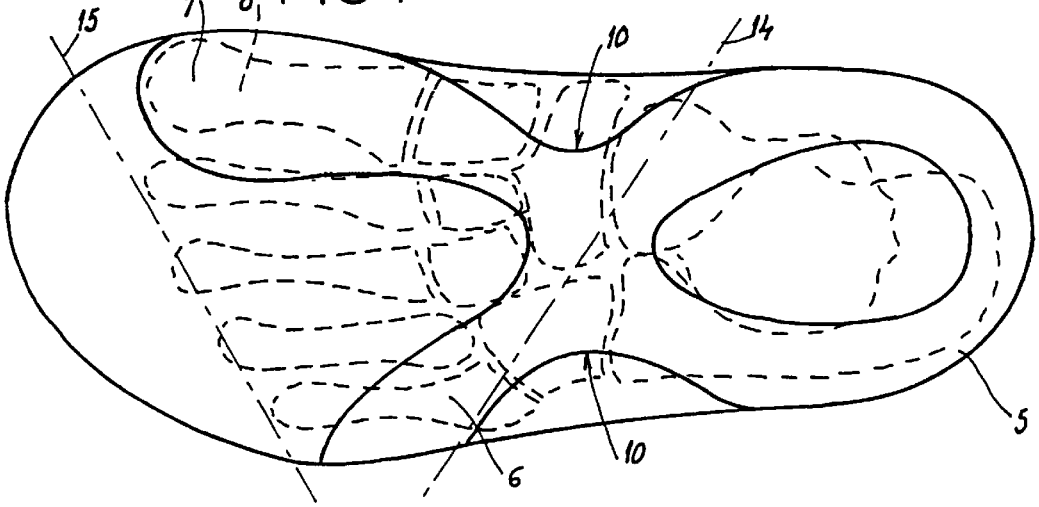
FIG. 4 is a view thereof from beneath.

As shown in FIG. 4, the branch 7 located on the inside of the sole extends forward beyond the first metatarsal head 8. The central zone 9 of the strengthener, located forward of the zone on which the heel presses, that is to say forward of the loop 5, is raised with respect to the zones located in front of and behind it, so as to hold the heel firmly in place and improve performance, as indicated earlier. In its central zone located forward of the zone on which the heel presses, the strengthener has two lateral recesses 10, the far ends of which are set back from the respective lateral edges of the sole. This makes it possible to uncover the flexible zones of the foot, so as to respect their dynamic functions of flexibility.

Figure 6:
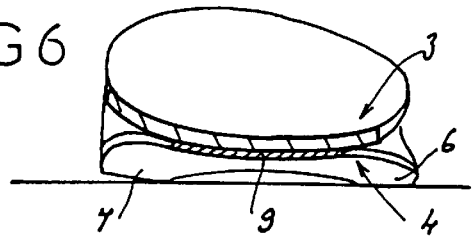

The main part 3 of the sole comprises, in the zone 12 on which the heel presses, and in a zone 13 located between the branches 6, 7 of the strengthener, in each case an upwardly facing bulge 31, 32 corresponding to a downwardly facing concave hollow 41, 42. During walking, pressure is exerted in the zones 12, 13, squashing the bulge 31, 32 and tending to close the loop, or to pull the branches 6, 7 together, as is shown in FIGS. 5 and 7. FIG. 6 for its part depicts the raised part of the central zone 9 of the strengthener which holds the heel in place. As shown in particular in FIG. 4, the branch 6 on the one hand has a longitudinal part and, on the other hand, forms an oblique line between the part located forward of the loop and on the inside of the sole and the part on the outside of the sole. This oblique line 14 makes an angle of between 60 and 90° with the bend line 15 of the front of the foot, or metatarsal break, this oblique line allowing the foot to tilt physiologically from the lateral to the medial to ease and guide the unfurling of the pressure points.

FIG. 8 depicts a second embodiment in which the strengthener is made of an elongate piece in the form of a band which is bent round on itself to form a loop 16, and the free ends of which form the longitudinal branches 17 and 18. The zone 19 where the two branches cross forms the extra thickness which provides the support forward of the heel. It may be noted that, when it is bent round to form a loop, the band inclines from the inside outward and from the bottom upward in the zone that accommodates the heel, which encourages guidance thereof.

FIG. 9 depicts another embodiment in which the strengthener is made in two parts, that is to say a part 20 forming a loop 22 extended by a part 23 forming a longitudinal branch located on the inside of the sole. The strengthener comprises a second part 24, which forms an oblique part extending from the inside edge of the sole, in the region located forward of the loop 22, to the outside edge of the sole in the zone of the fifth metatarsal. The part 24 is fixed to the part 20 and may, for example, be made of a different material from the material of which the part 20 is made, for example of a material which is more rigid to encourage the effect of tilting about the previously defined oblique axis.

FIG. 10 depicts a sole which is an alternative form of the one in FIG. 8 and in which the same elements are denoted by the same references as before. In this sole, the ends of the branches 17, 18 are connected by a bridge 25 allowing the body weight to be transferred onto the other branch if the weight is exerted too heavily on one of them. Furthermore, the underside of the branch 17 is equipped with an elastic pad 26 encouraging this effect of realigning or transferring the body weight onto the other branch.

As is evident from the foregoing, the invention provides a great improvement to the known art by supplying an insole for footwear which provides the foot with lateral stability, guides it in its longitudinal movement while at the same time encouraging propulsion, absorbing shocks, allowing venous drainage and an effect of massaging the sole of the foot, and above all assisting the foot in the restitution of its elastic reserve.

As goes without saying, the invention is not restricted simply to the embodiments of this sole which have been described hereinabove by way of example; on the contrary it encompasses all alternative forms thereof. Thus, in particular, the strengthener could be made not independently of the body of the sole and fixed under this sole later, but form an integral part of the body of the sole or, alternatively, the strengthener could be incorporated into the main sole of the item of footwear without in any way departing from the scope of the invention.

What is claimed is:

1. Sole for footwear, curved into the overall shape of a foot or intended to be adapted to the particular shape of a foot, of the type comprising a surface essentially corresponding to that of the bottom of the item of footwear and capable of being fitted with at least one of localized support and shock-absorbing elements, the sole comprising:

a strengthener in the form of a closed loop which surrounds a zone on which the heel rests and is extended forward in the form of two branches extending along two edges of the sole at least as far as a zone of first and fifth metatarsal heads, wherein the strengthener is made from an elongate single piece bent to form a loop and having ends which form two longitudinal branches after crossing in a crossing zone located forward of the heel.

2. The sole of claim 1, wherein a branch located on an inside of the sole extends forward beyond the first metatarsal head.

3. The sole of claim 1, wherein a central zone of the strengthener located forward of the zone on which the heel rests is raised relative to zones arranged in front of and behind it.

4. The sole of claim 1, wherein in the central zone, the strengthener has two lateral recesses, the two lateral recesses having far ends which are set back from respective lateral edges of the sole.

5. The sole of claim 1, wherein a main part of the sole comprises, in at least one of the zone on which the heel rests and a zone that lies between the two branches of the strengthener, an upwards facing bulge corresponding to a downwards facing concave hollow.

6. The sole of claim 1, wherein the strengthener is made of a synthetic material or of a composite material chosen from a group consisting of polymers, polycarbonates, polycarbolactols or carbon- or glass-fibre-reinforced resin.

7. The sole of claim 1, wherein the strengthener is made as a single piece obtained by cutting a shape from a larger piece.

8. The sole of claim 1, wherein the ends of the branches are connected by a bridge.

9. The sole of claim 1, wherein at least one of the branches is equipped with a localized elastic pad or string.

10. The sole of claim 1, the two branches are secured together or attached in an elastic and adjustable fashion in the crossing zone.

11. Sole for footwear, curved into the overall shape of a foot or intended to be adapted to the particular shape of a foot, of the type comprising a surface essentially corresponding to that of the bottom of the item of footwear and capable of being fitted with at least one of localized support and shock-absorbing elements, the sole comprising:

a strengthener in the form of a closed loop which surrounds a zone on which the heel rests and is extended forward in the form of two branches extending along two edges of the sole at least as far as a zone of first and fifth metatarsal heads, wherein the strengthener is made in two parts of which a first part forms the loop and a branch located on an inside of the sole and of which a second part, fixed to the first part on the inside of the sole and in a zone forward of the loop formed by the strengthener, extends essentially transversely with respect to an axis of the sole to meet an outside edge of the sole and form the second longitudinal branch.

12. The sole of claim 11, wherein the two parts of the strengthener are made of different materials.

13. The sole of claim 11, wherein the ends of the branches of the strengthener are connected by a bridge.

14. The sole of claim 11, wherein at least one of the branches of the strengthener is equipped with a localized elastic pad or spring.

* * * * *